United States Patent [19]

Smith et al.

[11] Patent Number: 4,977,928

[45] Date of Patent: Dec. 18, 1990

[54] LOAD SENSING HYDRAULIC SYSTEM

[75] Inventors: Glenn G. Smith, Lockport; Edward L. Stapleton, Joliet, both of Ill.

[73] Assignee: Caterpillar Inc., Peoria, Ill.

[21] Appl. No.: 520,007

[22] Filed: May 7, 1990

[51] Int. Cl.[5] ..... F15B 13/06

[52] U.S. Cl. ..... 137/596; 60/422; 60/424; 91/513; 91/516; 91/520

[58] Field of Search ..... 60/422, 424; 91/513, 91/516, 520; 137/596

[56] References Cited

U.S. PATENT DOCUMENTS 3,881,512 5/1975 Wilke .

4,343,151 8/1982 Lorimor ..... 91/520 X

*Primary Examiner*—Gerald A. Michalsky

*Attorney, Agent, or Firm*—John W. Grant

[57] ABSTRACT

Load sensing hydraulic systems conserve energy by generating only the fluid flow demanded by the system and at a pressure only slightly greater than the highest load pressure of the system. Optimizing the operating characteristics of the system for certain applications also caused the variable displacement pump to go to its maximum displacement setting with the excess fluid generated thereby not doing any useful work. The load sensing hydraulic system includes a flow control valve connected to a directional control valve and has an operating position in which fluid exhausted from a hydraulic jack is transmitted therethrough to a tank. A signal valve is disposed in a control pressure signal line for controlling fluid flow therethrough from a supply conduit to one end of the flow control valve. When the signal valve is blocking fluid flow through the signal line, the flow control valve is in the above-noted operating position. When the signal valve permits fluid flow through the signal line, the flow control valve is moved to a position to block fluid flow therethrough to the tank. The signal valve is connected to the directional control valve for movement therewith to establish the blocking or fluid transmitting positions.

5 Claims, 1 Drawing Sheet

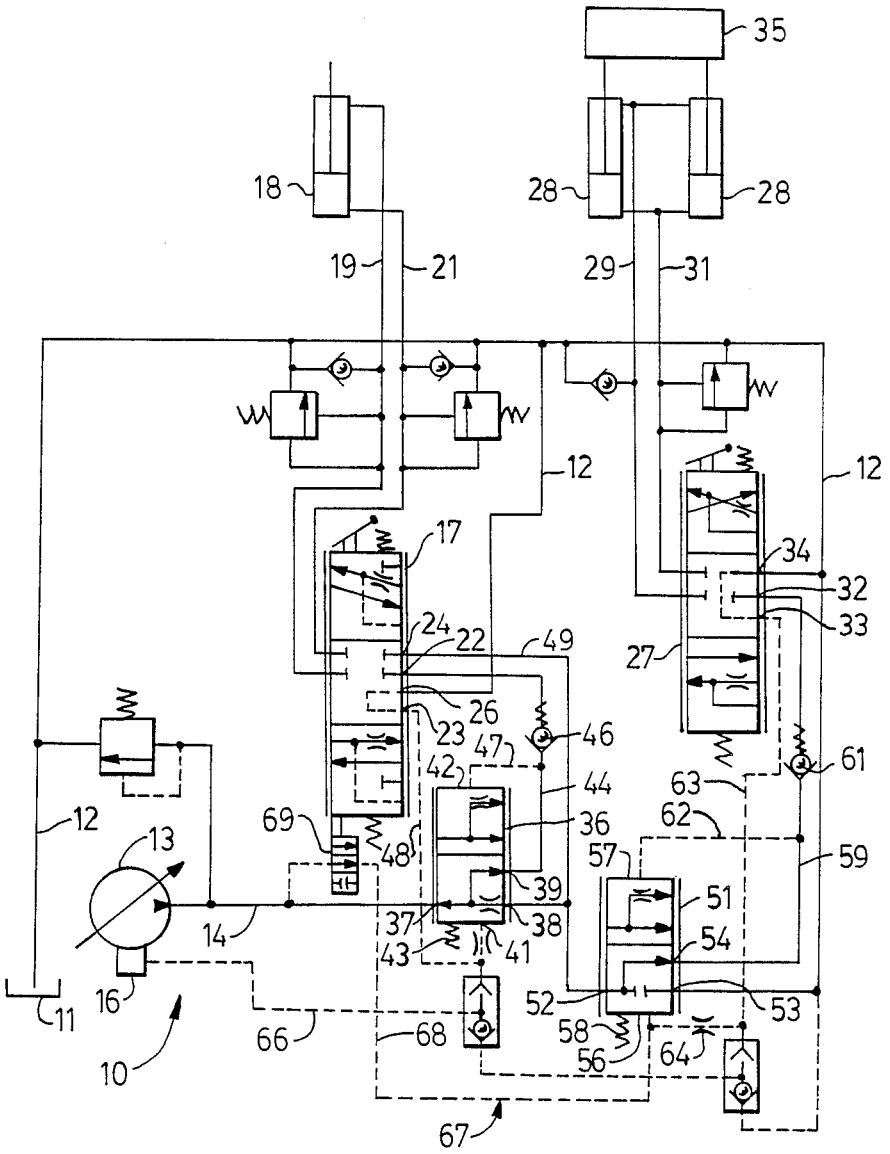
35
18
28
28
19
21
29
31
12
12
17
34
32
33
24
22
49
27
26
23
47
46
61
42
44
63
62
69
36
48
57
59
13
39
51
37
38
54
14
43
41
52
53
16
11
66
68
58
56
64
10
67

LOAD SENSING HYDRAULIC SYSTEM

DESCRIPTION

1. Technical Field

This invention relates to a load sensing hydraulic system and more particularly to a hydraulic system in which one of the pressure compensated flow control valves is rendered inoperative during certain operating conditions of the system.

2. Background Art

Load sensing hydraulic systems commonly have a pressure compensated flow control valve associated with each of the directional control valves with the function thereof being to establish a predetermined pressure differential across the associated directional control valve when it is in an operating position. Many of such load sensing systems have the flow control valves connected in series so that a circuit associated with one of the flow control valves has priority over a flow control valve associated with a downstream circuit. The upstream flow control valves are generally of the power beyond type wherein fluid in excess of that required to satisfy the demand of the upstream circuit is available for use by the downstream circuit if so desired. To obtain certain operating characteristics in some such systems, the fluid exhausted from the hydraulic jack of the upstream circuit at one operating position of the associated directional control valve is directed to the downstream flow control valve for use by the circuit associated therewith. This permits simultaneous actuation of the hydraulic jacks even though the total pump output is being utilized by the upstream circuit. If simultaneous actuation of the hydraulic jacks is not desired, the downstream flow control valve has an operating position at which the flow exhausted from the upstream circuit is communicated with the tank. One of the problems encountered with such systems is that the downstream flow control valve cannot distinguish between fluid being exhausted from the upstream circuit and fluid passing through the upstream flow control valve as part of its power beyond function and thus moves to that operating position every time any of the upstream circuits are actuated. This then causes the pump to stroke up to maximum displacement irregardless of how much fluid is actually needed to satisfy the operating parameters of the actuated circuits. The excess fluid flow generated by the pump under that condition simply passes through the downstream flow control valve to the tank without doing any useful work and therefore results in a waste of energy.

The present invention is directed to overcoming one or more of the problems as set forth above.

DISCLOSURE OF THE INVENTION

In one aspect of the present invention, a load sensing hydraulic system includes a tank, a return conduit connected to the tank, a variable displacement pump, a supply conduit connected to the pump, a directional control valve movable between a neutral and first and second operating positions, a pressure compensated flow control valve connected to the supply conduit, a supplemental supply conduit connected to the directional control valve and to the flow control valve, a second pressure compensated flow control valve connected to the supplemental supply conduit and to the return conduit and being movable between a first operating position at which the supplemental supply conduit is blocked from the return conduit and a second operating position at which the supplemental supply conduit communicates with the return conduit, said second flow control valve having first and second ends and a spring disposed at the first end biasing the valve to the first position, and means for communicating fluid from the supply conduit to the first end of the second flow control valve when the directional control valve is in either the neutral or the first operating position and for blocking communication between the supply conduit and the first end of the second flow control valve when the directional control valve is in the second operating position.

The present invention relates to a load sensing hydraulic system in which a downstream flow control valve is maintained in a position for blocking fluid flow therethrough to a tank under operating conditions in which fluid flow therethrough is not needed. By blocking fluid flow through the flow control valve, the displacement of the variable displacement pump is commensurate with that necessary to satisfy the demand for fluid by the upstream circuit. This then minimizes the generation of excess fluid flow by the pump and therefore conserves energy.

BRIEF DESCRIPTION OF THE DRAWINGS

The sole FIGURE is a schematic illustration of an embodiment of the present invention.

BEST MODE FOR CARRYING OUT THE INVENTION

Referring now to the drawing, a load sensing hydraulic system 10 includes a tank 11, a return conduit 12 connected to the tank, a load sensing variable displacement pump 13 connected to the return conduit and a fluid supply conduit 14 connected to the variable displacement pump 13. The variable displacement pump 13 includes a pressure responsive displacement control 16.

A directional control valve 17 is connected to opposite ends of a hydraulic jack 18 through a pair of motor lines 19 and 21 in the usual manner. The control valve 17 has an inlet port 22, a load pressure signal port 23, and a pair of outlet ports 24 and 26 with the outlet port 26 being connected to the return conduit 12. Similarly, another directional control valve 27 is connected to opposite ends of a pair of load supporting hydraulic jacks 28 through a pair of motor lines 29 and 31. The control valve 27 includes an inlet port 32, a load pressure signal port 33, and an outlet port 34, with the outlet port being connected to the return conduit 12. The directional control valves 17 and 27 and shown in a neutral position and are movable downwardly as viewed in the drawing from the neutral position to a first operating position and upwardly from the neutral position to a second operating position.

For illustrative convenience, the hydraulic jacks 28 are illustrated as being adapted to raise or lower a load 35. One example of such load would be for the hydraulic jacks 28 being connected to the lift arms of a loader in which case the hydraulic jack 18 would be actuatable for controlling a bucket mounted on the distal ends of the lift arms. Moreover, while the directional control valves are shown as manual control valves, they can also be pilot control valves.

A pressure compensated flow control valve 36 has an inlet port 37, a pair of outlet ports 38,39, opposite ends 41,42, and a spring 43 positioned at the end 41. The supply conduit 14 is connected to the inlet port 37. A service passage 44 connects the outlet port 39 to the inlet port 22 of the directional control valve 17 through a load check valve 46. A pilot passage 47 connects the service passage 44 to the end 42 of the flow control valve 36. A load pressure signal passage 48 connects the signal port 23 of the control valve 17 to the end 41 of the flow control valve 36. A supplemental supply conduit 49 is connected to the outlet port 38 of the flow control valve 36 and to the outlet port 24 of the directional control valve 17.

Another pressure compensated flow control valve 51 has an inlet port 52, a pair of outlet ports, 53,54, opposite ends 56,57, and a spring 58 positioned at the end 56. The supplemental conduit 49 is connected to the inlet port 52. The outlet port 53 is connected to the return conduit 12. A service passage 59 connects the outlet port 54 to the inlet port 32 of the directional control valve 27 through a load check valve 61 and is in continuous communication with the supplemental supply conduit 49. A pilot passage 62 connects to the service passage 59 to the end 57 of the flow control valve 51. A load pressure signal passage 63 connects the signal port 33 of the directional control valve 27 with the end 56 of the flow control valve 51. An orifice 64 is disposed in the signal passage 63.

A load pressure signal network 66 is provided to transmit the highest load pressure in signal lines 48 or 63 to the displacement control 16 in the usual manner.

A means 67 is provided for communicating fluid from the supply conduit 14 to the end 56 of the pressure compensated flow control valve 51 when the directional control valve 17 is in either the neutral or first operating position and for blocking communication between the supply conduit 14 and the end 56 of the flow control valve 51 when the directional control valve 17 is in the second operating position. The means 67 includes a control pressure signal line 68 connected to the supply conduit 14 and to the end 56 of the flow control valve 51 and a signal valve 69 disposed in the signal line 68. The signal valve 69 is suitably connected to the directional control valve 17 for simultaneous movement therewith between open and closed positions. At the open positions, control fluid passes through the signal line 68 while fluid flow through the signal line is blocked at the closed position of the signal valve.

INDUSTRIAL APPLICABILITY

In the use of the load sensing hydraulic system 10 when both of the directional control valves 17 and 27 are in the neutral position shown, there is no load pressure in the signal network 66. Under this condition the load sensing pump 13 automatically destrokes to a position to maintain a stand-by pressure in the supply conduit 14 which in this embodiment is about 2000 kPa. The pressurized fluid in the supply conduit 14 passes through the flow control valve 36, the service passage 44 and the pilot passage 47, where it acts on the end 42 of the flow control valve 36 moving it downwardly against the spring 43. With the flow control valve 36 in the downward position, pressurized fluid from the supply conduit passes through the flow control valve 36, the supplemental supply conduit 49, the flow control valve, the service passage 59 and the pilot passage 62 where it acts on the end 57 of the flow control valve 51. However, with the directional control valve 17 in the neutral position shown, the valve 69 is also in the position shown thereby permitting pressurized fluid from the supply conduit 14 to pass through the signal line 68 where it acts on the end 56 of the flow control valve 51. The force generated by the pressurized fluid in the supply conduit 68 is combined with the force of the spring 58 to maintain the flow control valve 51 in the position shown at which the supplemental supply conduit 49 is blocked from the return conduit 12. A very small amount of pressurized fluid will pass from the supply conduit 68 through the orifice 64, the signal passage 63, the directional control valve 27, outlet port 34, and into the drain conduit 12.

To extend the hydraulic jack 18, the directional control valve 17 is moved downwardly to the first operating position at which the service passage 44 is in communication with the motor line 21 and the motor line 19 is in communication with the return conduit 12. The signal port 23 communicates the load pressure in the motor line 21 with the signal passage 48 and the resolver network 66 which transmits the load pressure the displacement control 16 of the load sensing pump 13. The displacement control 16 functions in the conventional manner to control the displacement of the pump 13 to maintain a first predetermined pressure differential between the pressure in the supply conduit 14 and the pressure in the signal network 66 which in this case is the pressure required to move the hydraulic jack 18. The pressure compensated flow control valve 36 functions in the conventional manner to maintain a second predetermined pressure differential between the fluid pressure in the service passage 44 and the signal passage 48. In this embodiment, the first predetermined pressure differential can be approximately 2000 kPa, and the second predetermined pressure differential can be approximately 350 kPa. Thus, the fluid flow and pressure in the supply conduit 14 and service passage 44 increases to meet the demand called for by the directional control valve. Downward movement of the directional control valve 17 to the first operating position simultaneously moves the valve 69 to another operating position in which fluid flow through the signal line 68 is maintained such that the flow control valve 51 is maintained in the position shown blocking the flow of fluid from the supplemental supply conduit 49 to the return conduit 12.

Retracting the hydraulic jack 18 is initiated by moving the directional control 17 upwardly to connect the service passage 44 with the motor line 19 and the motor line 21 with the supplemental supply conduit 49. At this position of the directional control valve, the displacement control and flow control valve 36 function as previously described. However, the fluid exhausted from the hydraulic jack 18 through the motor line 21 passes through the supplemental supply conduit 49 and the flow control valve 51 and into the service passage 61 and the pilot passage 62. Moreover, upward movement of the directional control valve 17 simultaneously moves the valve 69 to a position blocking fluid flow through the signal line 68. Thus, with the control valve 27 in the neutral position shown, fluid pressure builds up in the service passage 59 and pilot passage 63 to urge the flow control valve 51 downwardly to communicate the supplemental supply conduit 49 with the return conduit 12. The fluid being exhausted from the hydraulic jack 18 becomes available for use by the directional control valve 27 for actuation of the hydraulic jacks 28. More specifically if the directional control valve 27 is moved downwardly under this condition, pressurized fluid from the service passage 59 is communicated through the inlet port 32 and into the motor line 31 to extend the hydraulic jacks 28. The load pressure in the conduit 31 is transmitted through the signal port 33 and signal passage 63 to the end 56 of the flow control valve 51. The flow control valve 51 thus acts as a pressure compensated valve to maintain a third predetermined pressure differential between the service passage 59 and the motor line 31. A similar situation will occur if the directional control valve 27 is moved upwardly for retraction of the hydraulic jacks 28 while the directional control valve 17 is in its second operating position.

If the directional control valve 27 is moved to either operating position while the directional control valve 17 is in the neutral position, the flow control valve 51 will remain in the position shown by virtue of the pressurized fluid passing from the supply conduit 14 through the signal valve 69 and signal line 68 to the end 56 of the flow control valve 51 as previously described. Since the fluid pressure in the supply conduit 14 will always be higher than the load pressure downstream of the directional control valve 27, the flow control valve 51 will remain in the position shown. However, since the load pressure from the hydraulic jacks 28 is transmitted through the signal passage 63 and the signal network 66 to the displacement controller 16, a pressure differential of approximately 2000 kPa will be maintained across the directional control valve 27.

In view of the above, it is readily apparent that the present invention provides an improved load sensing hydraulic system in which a second or downstream flow control valve is maintained in a position for blocking fluid flow therethrough to a tank under operating conditions in which fluid flow therethrough is not needed and is allowed to move to a position permitting fluid flow therethrough under operating conditions in which fluid flow therethrough is needed. This is achieved by communicating fluid from a supply conduit to an end of the flow control valve when the directional control valve is in a position which establishes the condition at which fluid flow is not needed and by blocking communication of fluid from the supply conduit to the end of the flow control valve when the directional control valve is in a position which establishes the condition at which fluid flow is needed. By blocking fluid flow therethrough, the displacement of the variable displacement pump is commensurate with that necessary to satisfy the demand for fluid by the upstream circuit. This then minimizes the generation of excess fluid flow by the pump and therefore conserves energy.

Other aspects, objects, and advantages of this invention can be obtained from a study of the drawing, the disclosure, and the appended claims.

What is claimed:

1. A load sensing hydraulic system comprising:

a tank;

a return conduit connected to the tank;

a variable displacement hydraulic pump;

a supply conduit connected to the pump;

a directional control valve moveable between a neutral and first and second operating positions;

a pressure compensated flow control valve connected to the supply conduit;

a supplemental supply conduit connected to the directional control valve and to the flow control valve;

a second pressure compensated flow control valve connected to the supplemental supply conduit and to the return conduit and being moveable between a first position at which the supplemental supply conduit is blocked from the return conduit and a second position at which the supplemental supply conduit communicates with the return conduit, said second flow control valve having first and second ends and a spring disposed at the first end biasing the valve to the first position; and means for communicating fluid from the supply conduit to the first end of the second flow control valve when the directional control valve is in either the neutral or the first operating position and for blocking communication between the supply conduit and the first end of the second flow control valve when the directional control valve is in the second operating position.

2. The load sensing hydraulic system of claim 1 wherein said communicating and blocking means includes a control pressure signal line connected to the supply conduit and the first end of the second flow control valve and a signal valve disposed in the signal line and being movable between open and closed positions, said signal valve being connected to the directional control valve and moved between the open and closed positions in response to movement of the directional control valve wherein the signal valve is in the open position when the directional control valve is in either the neutral or second operating position and is in the closed position when the directional control valve is in the first operating position.

3. The load sensing hydraulic system of claim 2 including a second directional control valve, a service passage connected to the second flow control valve and to the second directional control valve and being in continuous communication with the supplemental supply conduit, and a pilot passage connecting the service passage to the second end of the second flow control valve.

4. The load sensing hydraulic system of claim 3 including a load pressure signal passage connected to the second directional control valve and to the signal line, and an orifice disposed in the load pressure signal passage.

5. The load sensing hydraulic system of claim 4 wherein said variable displacement pump has a pressure responsive displacement control and including a load pressure signal means for directing the highest load pressure of the hydraulic system to the pressure responsive displacement control, said load pressure signal passage being a component of the load pressure signal means.

* * * * *